United States Patent [19]

Balinski

[11] 4,034,531

[45] July 12, 1977

[54] CEILING SYSTEM

[75] Inventor: Henry A. Balinski, Hoffman Estates, Ill.

[73] Assignee: United States Gypsum Company, Chicago, Ill.

[21] Appl. No.: 672,949

[22] Filed: Apr. 2, 1976

[51] Int. Cl.[2] ..... E04B 5/52; E04B 3/54

[52] U.S. Cl. ..... 52/484; 52/489; 52/496; 52/475

[58] Field of Search ..... 52/488, 303, 401, 475, 52/665, 461, 434, 483, 22, 484, 489, 496, 501; 49/7; 98/40 D

[56] References Cited

U.S. PATENT DOCUMENTS

| | | | |
|---|---|---|---|
| 2,767,440 | 10/1956 | Nelsson | 52/488 |
| 3,062,298 | 11/1962 | Nash | 49/7 |
| 3,103,868 | 9/1963 | Kodaras | 98/40 D |
| 3,202,077 | 8/1965 | Lee | 52/475 |
| 3,207,057 | 9/1965 | Brown et al. | 52/475 |
| 3,301,165 | 1/1967 | Stanley | 98/40 D |
| 3,375,630 | 4/1968 | Dail | 52/475 |
| 3,390,624 | 7/1968 | Auerill | 98/40 D |
| 3,440,789 | 4/1969 | Harding | 52/461 |
| 3,577,904 | 5/1971 | Lambert | 52/303 |
| 3,596,425 | 8/1971 | Kodaras | 52/476 |
| 3,708,932 | 1/1973 | Bailey et al. | 52/484 |
| 3,708,941 | 1/1973 | Cuckson | 52/484 |
| 3,742,674 | 7/1973 | Lang | 52/484 |
| 3,757,666 | 9/1973 | Lambert | 98/40 D |
| 3,757,668 | 9/1973 | Dean | 98/40 D |
| 3,783,771 | 1/1974 | Hartzell et al. | 52/484 |
| 3,969,865 | 7/1976 | Andersen | 52/483 |

*Primary Examiner*—Price C. Faw, Jr.
*Assistant Examiner*—Robert C. Farber
*Attorney, Agent, or Firm*—Donnie Rudd; Kenneth E. Roberts; Samuel Kurlandsky

[57] ABSTRACT

A support runner for use in a suspended ceiling system is disclosed with the support runner being useful in ceiling systems having an exposed flange for decorative purposes. The support runner has a decorative trim having a decorative lower surface and an engageable upper surface. An inverted-T runner is supportingly engaged about the engageable upper surface of the decorative trim and extends along the decorative trim a distance sufficiently less than the length of the trim to accomodate heat expansion distortion of the inverted-T runner. When the ceiling system is exposed to heat, the inverted-T runner continues to hold the ceiling panels even though the decorative trim becomes inoperable due to expansion caused by the heat.

8 Claims, 4 Drawing Figures

CEILING SYSTEM

BACKGROUND OF THE INVENTION

1. Field of the Invention

This invention relates to a support runner for use in suspended ceilings and the ceiling system made possible by use of the runner.

2. Description of the Prior Art

Suspended ceiling systems using inverted-T cross runners to support ceiling tile and the like are a common type of construction for office buildings and the like. In one type of design, the bottom portion of the inverted-T runner fits into kerfed areas in the ceiling tile and the ceiling tile present a continuous surface without exposure of the runner anywhere in the ceiling. In recent years, however, it has become desirable for appearance and design purposes to have an exposed runner to provide a highly decorative surface which interrupts the ceiling tile. Examples of various design of inverted-T runners having such a decorative surface are found in U.S. Pat. No. 2,767,440; U.S. Pat. No. 3,577,904; U.S. Pat. No. 3,757,668 and U.S. Pat. No. 3,207,057. Examples of modified runners to provide a highly decorative effect using a modification of the inverted-T runner include such designs as are disclosed in U.S. Pat. Nos. 3,596,425; 3,390,624; 3,440,789; and 3,301,165. Still other designs having a grooved decorative ceiling surface are shown in U.S. Pat. No. Des. 223,235 and U.S. Pat. No. 3,916,773. In each of these systems, the inverted-T runners are rigidly locked together to provide a rigid support for the ceiling system. A ceiling system provided by use of such supports has one serious deficiency. When the system is exposed to extreme heat, the T-runners expand and deform, and the ceiling tile fall from the T-runners as a result of this deformation.

Ceiling systems which overcome the problem of collapse upon exposure to heat have been almost nonexistant. One attempt to provide a fire guard in such systems is disclosed in U.S. Pat. No. 3,062,298, but this disclosure expressly provides for collapse of the ceiling to enable sprinkler devices to eliminate the fire. The only other known type of system is that which uses "knockout" portions in the runners and tees to accomodate expansion by controlled buckling, but the buckling than causes problems in retaining the ceiling tiles in place. It would be much more desirable to have the ceiling remain in place, and, if the ceiling is a fire-rated material, enable the ceiling to act as a fire barrier to prevent the fire from spreading to the supporting structure. To date, no known system has been provided for utilizing a decorative exposed flange with an inverted-T runner with construction sufficient to support the ceiling upon exposure to heat. The new and novel runners and ceiling systems provided in this invention make possible, for the first time, a ceiling system which overcomes all of the deficiencies of prior known systems.

SUMMARY OF THE INVENTION

It is an object of this invention to provide a support runner for use in suspended ceiling systems wherein the support runner will continue to support the ceiling upon exposure to heat.

It is the further object of this invention to provide a support runner having a highly decorative exposed surface but which will support a ceiling upon exposure to heat.

It is a further object of this invention to provide a ceiling system having decorative exposed flanges on support runners and wherein the ceiling tile will be held in place upon exposure to heat.

The objects of this invention are accomplished by a support runner for use in a suspended ceiling system of the type wherein the ceiling has an exposed flange for decorative purposes, said support runner comprising: a decorative trim having a decorative lower surface and an engageable upper surface; an inverted-T runner supportingly and movably engaged about the engageable upper surface of the decorative trim and extending along the decorative trim a distance sufficiently less than the length of the trim to accomodate heat distortion of the inverted-T runner; whereby when the ceiling system is exposed to heat the inverted-T runner continues to hold the ceiling even though the decorative trim becomes inoperable due to expansion caused by heat. More particularly, the support runner for use in this invention has an exposed flange which is decorative in appearance. The exposed flange may be of any type of decorative design, however, one design that is particularly useful is that which has a groove along the exposed surface to create a shadow effect in the installed ceiling or which can be used as a means of attachment for partitions, spot lights, signs, and the like. The groove is not only useful for decorative purposes, but also allows the decorative flange to collapse inwardly on expansion thereby allowing for some deformation prior to actual collapse of the decorative portion of the flange from the ceiling. The decorative flange can be made of any commonly used extrusion material, including extruded metals, such as aluminum, but may also include wood or plastic which have adaptability to the particular type of design desired.

The decorative flange of the runners is supported by an inverted-T runner which in turn supports the ceiling tile. Generally, the tile are cut so that they lay on top of the bottom portion of the inverted-T runner and extend downwardly so that the bottom surface of the ceiling tile is in a plane with the bottom surface of the exposed flange. The inverted-T runner must provide a means of support for the decorative flange. For this purpose it is preferred that the bottom of the inverted-T runner clamp over the outside of the top of the exposed flange to provide the support but other designs which provide for the support and which have the conditions set forth herein are also equally useful within the scope of this invention. The inverted-T runner must support the exposed flange in a movably engageable manner, that is, any manner which allows for movement of the exposed flange along the inverted-T runner when the exposed flange expands due to exposure due to heat. This is accomplished by having the crimp or catch on the inverted-T runner hold the exposed flange in a slightly loose manner rather than have the crimp so tight that the exposed flange will not move along the inverted-T runner.

Another essential in the design of the support runners of this invention is that the inverted-T runner must not extend to the edges of the exposed flange. The inverted-T runner must be discontinued near the ends of the exposed flange a distance sufficient to insure that when the decorative flange drops away due to deformation and the inverted-T runner begins to expand due to exposure to the heat, the inverted-T runner expansion will not be sufficient to cause the ends of the T-runners to contact each other rigidly and deform. This gap at the end of the runners can easily be determined by taking into account the particular material used in the inverted-T runner, considering the desired length and known linear coefficient of expansion and providing a safety margin for the particular temperature of heat exposure sought to protect against. When the installed ceiling system is exposed to heat from a flame or the like, the exposed flange deforms, and may even drop away from the system, but the inverted-T runner will continue to remain in place and support the ceiling tile to present a barrier against spread of flame.

Still other objects will readily present themselves to one skilled in the art upon reference to the following specification, the drawings and the claims.

DESCRIPTION OF THE DRAWINGS

This invention may be more fully described, but is not limited, by the attached drawings wherein.

DESCRIPTION OF THE PREFERRED EMBODIMENTS

This invention may be more fully described, but is not limited, by reference to the attached drawings and following discussion of the preferred embodiments discussed hereinafter.

Figure 1:
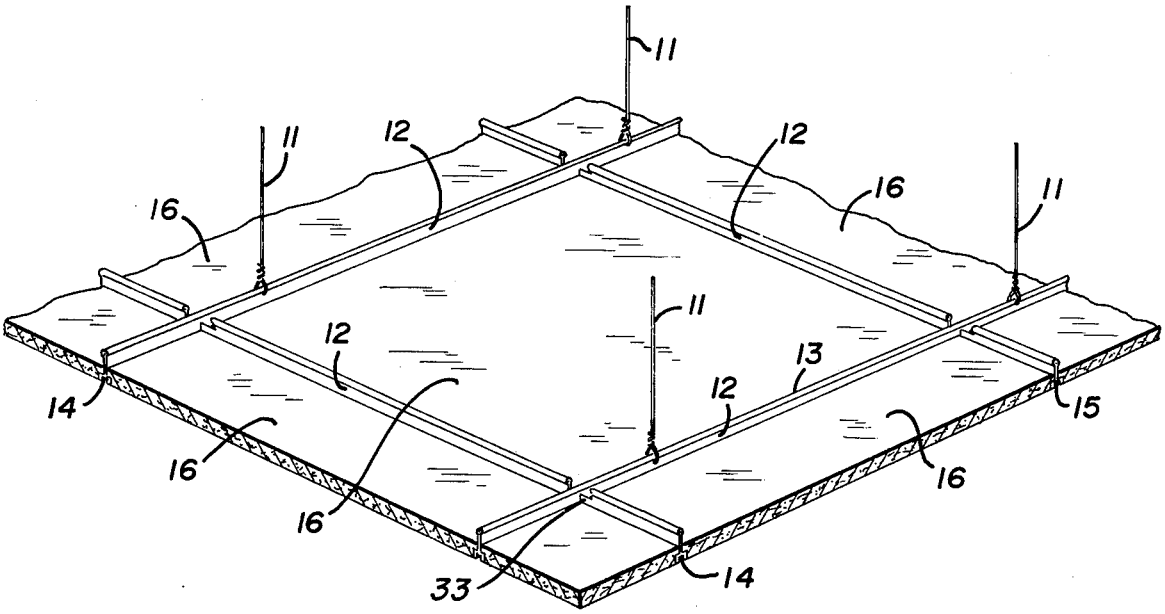
FIG. 1 is a top perspective view of an installed ceiling according to this invention.

FIG. 1 illustrates an installed ceiling system according to this invention wherein the ceiling system is supported by support wires 11 which are attached to a supporting structure. The supporting wires hold inverted-T runners 12, which may or may not have an enlarged upper portion 13, which stiffens the inverted-T runner and provides additional strength for the system. An exposed flange 14 provides a decorative surface underneath. A particularly desirable flange is one having a groove 15 on the underneath portion to create a shadow effect. Ceiling tiles 16 are supported on the inverted-T runners and may have a cutout portion, if desired, to enable the bottom surface thereof to be flush with the bottom surface of the exposed flange.

An additional feature of this invention is that when the decorative trim drops away due to heat, the inverted-T separates and helps to hold the ceiling tiles in place.

Figure 2:
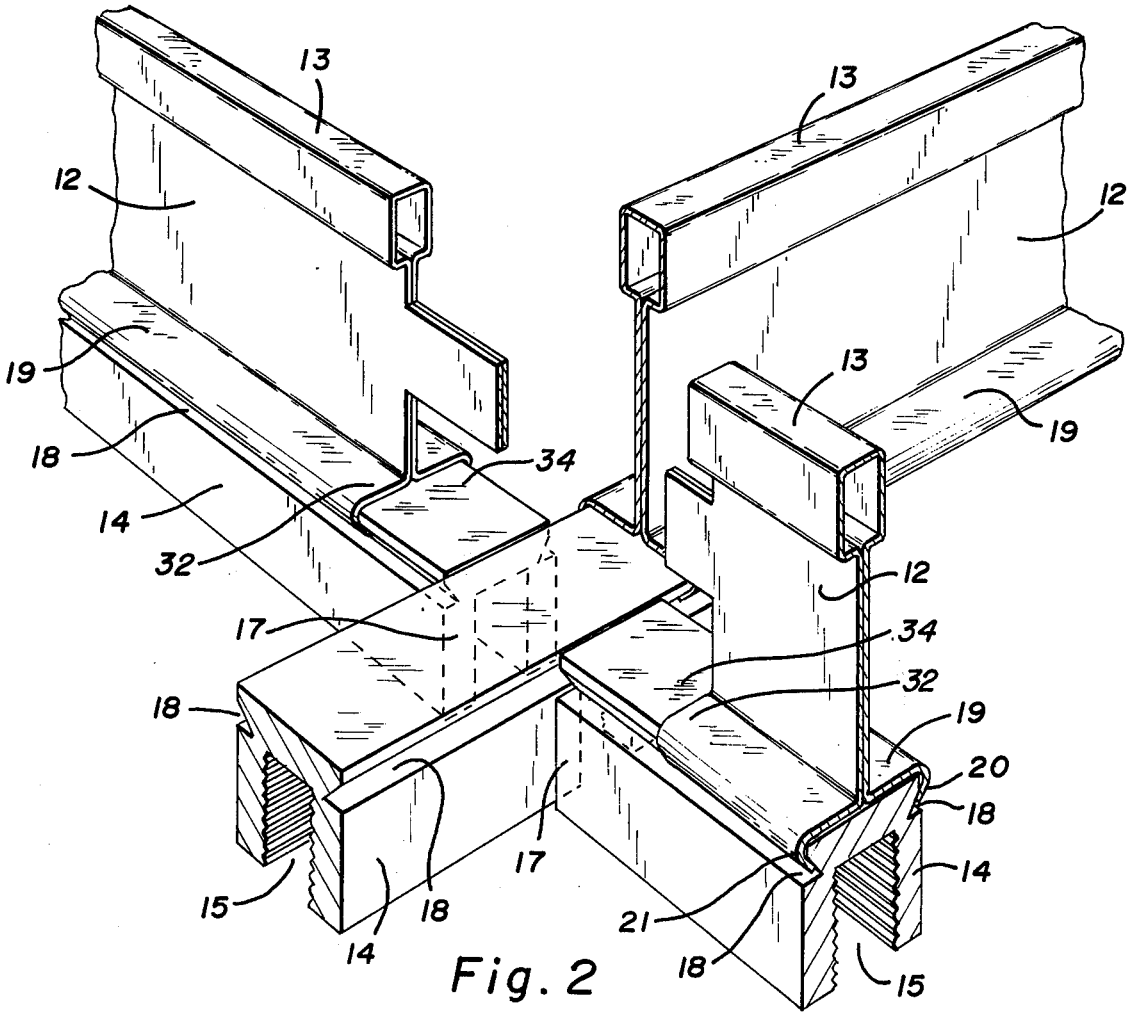
FIG. 2 is a perspective view illustrating the connection of ceiling runners according to this invention.

Referring to FIG. 2, the exposed flanges 14 abutt one another at ends 17 in order to provide a continuous decorative surface. The inverted-T runners, however, are discontinued at ends 32 a distance sufficiently spaced apart from the end of the decorative flange in order that expansion of the inverted-T runner, upon exposure to heat, will not cause the ends of the inverted-T runner to contact one another and deform due to the expansion. The inverted-T runners may be connected to one another in a conventional manner such as the flanges 33, shown in FIG. 3, of one end of one inverted-T runner engaging a slot in a second T-runner. The top end portion 34 of the decorative flange is not discontinued at the end of the flange if such a discontinuation would allow one to see through the ceiling.

Figure 3:
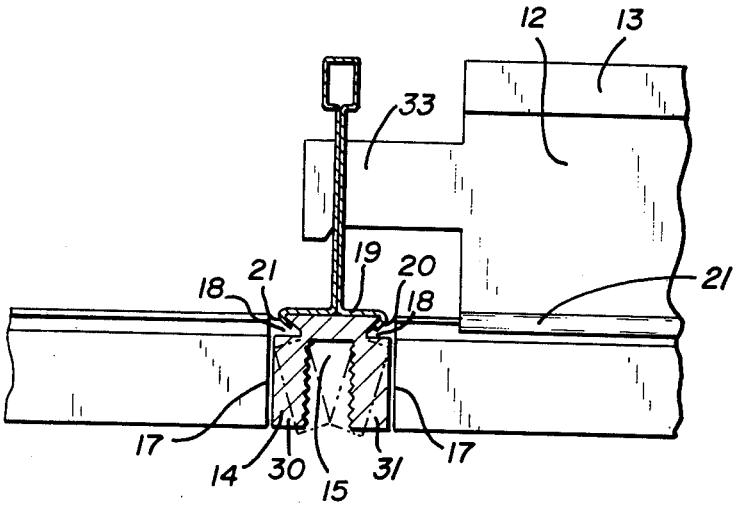
FIG. 3 is cross-sectional view of an installed runner according to this invention and showing heat deformation of the exposed flange.

While many designs are possible for connecting the inverted-T runner to the decorative flange, a highly functional design is the embodiment shown in FIG. 2 and FIG. 3 wherein the top of the decorative flange has slots 18 having a generally triangular cross-section and with the inverted-T runner 12 having its bottom cross-member 19 having opposing ends 20 and 21 formed over the exposed flange thereby engaging the top of the exposed flange in a supporting manner.

It is important that the exposed flange be able to move along the inverted-T runner when the exposed flange expands due to heat, and this can be provided by insuring that the exposed flange and inverted-T runner are not so rigidly connected as to prevent this movement. Other designs which provide for supporting action and releasability upon expansion can readily be determined by one skilled in the art.

Figure 4:
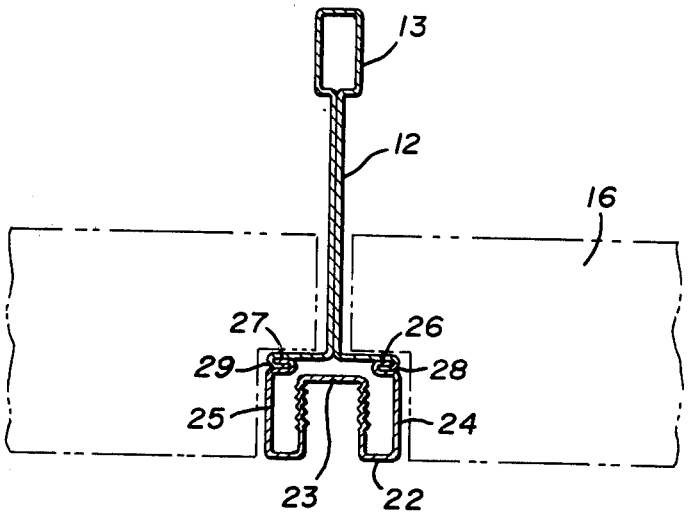
FIG. 4 is a cross-sectional view of an alternative design of the runner of this invention.

In FIG. 4 an alternative embodiment is disclosed with the decorative exposed flange 22 being hollow and comprising a U-shaped member 23 having the opposing ends 24 and 25 bent outwardly and upwardly and then inwardly and outwardly at the extreme end portions 26 and 27 to provide for engagement by the ends of the inverted-T runner cross-member 28 and 29 respectively. Again the connection must not be rigid or firm in order to allow for expansion, but it must be sufficient to support the system. In FIG. 4 the ceiling tile 16 is shown with a cutout portion to allow for the flush arrangement of the ceiling tile.

FIG. 3 illustrates, in phantom, the deformation of sidewalls 30 and 31 of the exposed flange upon exposure to heat. If the heat is sufficiently high and sufficiently continuous in nature, and if the exposed flange comes within its degradation conditions or is exposed to continuous heat above its melting point, it will drop from the inverted-T runner, but the inverted-T runner will continue to support the ceiling tile and present a continuous barrier against spread of the flame.

While only several forms and embodiments of the invention have been shown and described, other forms and embodiments within the spirit and scope of the invention will become apparent to those skilled in the art. Therefore, the forms and embodiments shown in the drawings are to be considered as merely setting forth the invention for illustrative purposes and are not intended to limit the scope of the in invention herein described and shown.

It may thus be seen that the new and novel runners and systems made possible by this invention provide a system having capabilities heretofore totally unknown in the construction industry. For the first time a ceiling system has been provided with exposed decorative flanges but having the capability of staying in place to present a flame barrier upon exposure to heat. This new and novel design is a significant advance in the construction industry.

Having fully described this new and unique invention, the following is claimed:

1. A suspended ceiling in which suspended ceiling panels are retained in place even though an exposed supporting ceiling runner is exposed to heat sufficient to cause deformation of the exposed portion, said ceiling comprising a plurality of interconnected support runners connected to a supporting structure and having ceiling panels resting on the support runners, said support runners comprising a decorative trim having a decorative lower surface and an engageable upper surface, and an inverted-T runner supportingly and movably engaged about the engageable upper surface of the decorative trim and extending along the decorative trim a distance sufficiently less than the length of the trim to prevent heat distortion of the inverted-T runner; whereby when the ceiling system is exposed to heat the inverted-T runner continues to hold the ceiling even though the decorative trim becomes inoperable due to expansion caused by the heat.

2. A suspended ceiling in which suspended ceiling panels are retained in place even though an exposed supporting ceiling runner is exposed to heat sufficient to cause deformation of the exposed portion, said ceiling comprising a plurality of interconnected support runners connected to a supporting structure with ceiling panels resting on the support runners, said support runners comprising a decorative trim runner member having a lower decorative surface and an upper holding surface, said upper holding surface comprising opposing outwardly extending side projections extending outwardly from the upper side portions of the decorative trim runner member; and an upper supporting member comprising an inverted-T runner capable of supporting ceiling panels and having trim engaging means engaging the outwardly extending side projections of the decorative trim runner member in a manner which allows for movement of the runner member along the inverted-T runner, said inverted-T runner having a length sufficiently short that expansion due to heating will not cause deformation due to contact with other runners in an installed ceiling system.

3. A suspended ceiling as in claim 2 wherein the decorative trim runner member has a groove extending along its lower surface.

4. A suspended ceiling as in claim 2 wherein the decorative trim runner member has an inverted U-shaped cross-section with grooves along the opposing top back sides of the runner member thereby creating the outwardly extending side projections.

5. A suspended ceiling as in claim 2 wherein the outwardly extending side projections on the decorative trim runner member slope inwardly toward the center of the runner member.

6. A suspended ceiling as in claim 2 wherein the upper supporting member has a stiffening section on its top portion.

7. A suspended ceiling as in claim 2 wherein the upper supporting member comprises an inverted-T runner having the opposing ends of the cross-portion of the T formed downwardly and inwardly for engaging and supporting the decorative trim.

8. A suspended ceiling as in claim 2 wherein the decorative trim runner member comprises a hollow member formed with opposing sides being upwardly extending plates terminating in bent sections capable of being engaged by the upper supporting member.

* * * * *